United States Patent [19]

Schreier

[11] 4,000,674

[45] Jan. 4, 1977

[54] ONE KEY CHORDING SYSTEM FOR AN ELECTRONIC KEYBOARD INSTRUMENT

[75] Inventor: Wilford Rayburn Schreier, Bensenville, Ill.

[73] Assignee: Hammond Corporation, Chicago, Ill.

[22] Filed: June 18, 1975

[21] Appl. No.: 587,905

[52] U.S. Cl. ..... 84/1.01; 84/1.03; 84/DIG. 22

[51] Int. Cl.[2] ..... G10H 1/00

[58] Field of Search ..... 84/1.17, DIG. 22, 1.07, 84/1.08, 1.01, 1.03, DIG. 23

[56] References Cited

UNITED STATES PATENTS

| | | | |
|---|---|---|---|
| 3,708,604 | 1/1973 | Hebeisen et al. | 84/1.17 X |
| 3,725,560 | 4/1973 | Robinson et al. | 84/1.17 X |

*Primary Examiner*—Ulysses Weldon
*Attorney, Agent, or Firm*—Neuman, Williams, Anderson & Olson

[57] ABSTRACT

A one key chording system for an electronic keyboard instrument of the type in which a single contact keyboard for DC keying of tone signals is employed. A primary keying signal from the single contact keyboard operates one of a plurality of chord gates to produce a chord keying signal which is translated by one of a set of chord logic units into secondary keying signals. The primary and secondary keying signals operate keyers for tone signals corresponding to a musical chord. An inhibit circuit prevents chord gates from responding to secondary keying signals. A mode control circuit switches the single key chording system off to return the instrument to normal operation with multiple key chording.

2 Claims, 4 Drawing Figures

| FIG. 3 | FIG. 4 |
|---|---|

ONE KEY CHORDING SYSTEM FOR AN ELECTRONIC KEYBOARD INSTRUMENT

This invention relates to one key chording systems for electronic keyboard instruments in which actuation of a single key on a standard keyboard causes the sounding of a complete musical chord rather than a single note at a single pitch or multiple pitches.

Prior art systems for accomplishing one key chording on a standard keyboard have typically involved either A.C. keying of chord tone signals using multiple contacts associated with each key of the keyboard or D.C. keying of chord tone signals using sets of D.C. keyers which are specially devoted to accomplish the one key chording feature and are provided in addition to sets of D.C. keyers for normal multiple key chording operation of the instrument. Examples of the former type of system are illustrated in Brand et al. U.S. Pat. No. 3,359,358, Bohm U.S. Pat. No. 3,681,508, and Southard U.S. Pat. No. 3,740,449. Examples of the latter type of system are Freeman U.S. Pat. No. 3,590,129, Bunger U.S. Pat. No. 3,629,481, and Hebeisen et al. U.S. Pat. No. 3,708,604. Another type of A.C. keying system is disclosed in Brand U.S. Pat. No. 3,665,088.

This invention features a one key chording system for a D.C. keyed electronic keyboard instrument which utilizes the same keyboard contacts and D.C. keyers that are employed in the normal multiple key chording operation of the instrument. In this manner the one key chording system of this invention provides this feature on an electronic keyboard instrument at a minimum of cost and enables the feature to be added to existing instruments without a major redesign of the existing organ system.

More particularly, this invention is especially useful in an electronic keyboard instrument of the type which includes the following elements which are known in the prior art:

a. a tone signal generating system for generating tone signals corresponding to notes in the musical scale;

b. an output system for translating tone signals into audible musical tones;

c. a set of tone signal keyers, each receiving one of the tone signals and being responsive to a keying signal on an input keying signal lead to key the tone signal to the output system; and d. a keyboard having a plurality of control elements, each of the control elements being identified in standard musical keyboard terms with a particular note of the musical scale and being selectively operable to apply a primary keying signal on an input keying signal lead of an associated keyer.

The one key chording system according to this invention adds the following elements:

1. a set of chord gates, each coupled to one of the keying signal leads and operative in response to a primary keying signal thereon to produce an output chord keying signal;

2. a set of chord logic units, each coupled to one of the chord gates and operative in response to a chord keying signal to supply a plurality of secondary keying signals to keying signal leads of a preselected group of keyers such that the primary and secondary keying signals will operate a group of keyers associated with notes comprising a musical chord; and 3. inhibit means coupled to the chord gates for inhibiting operation of the chord gates in response to secondary keying signals.

It should be understood that the particular chord assigned to each key must include the musical note associated with that particular key but this is not a limiting factor in the invention since in most cases the key will be assigned to the chord whose root note is associated with that key. This invention also preferably includes a mode control means coupled to the chord gates and operable selectively by the player to inhibit operation of all of the chord gates and thereby to return the instrument to the normal multi-key chording mode of operation.

The one key chording system of this invention is particularly advantageously employed in an electronic organ system which also includes an automatic bass system integrated with an automatic rhythm accompaniment device to provide rhythmic chord and bass note performance. With such a system the beginner musician can achieve satisfying musical performance from the organ by employing one finger on the solo keyboard for melody playing and one finger on the accompaniment keyboard for accompaniment chords and bass. Other features and advantages of the system will be apparent from the detailed description set forth below.

FIG. 1 is a block diagram of a one key chording system in accordance with this invention;

FIG. 2 illustrates the manner in which

Figure 3:
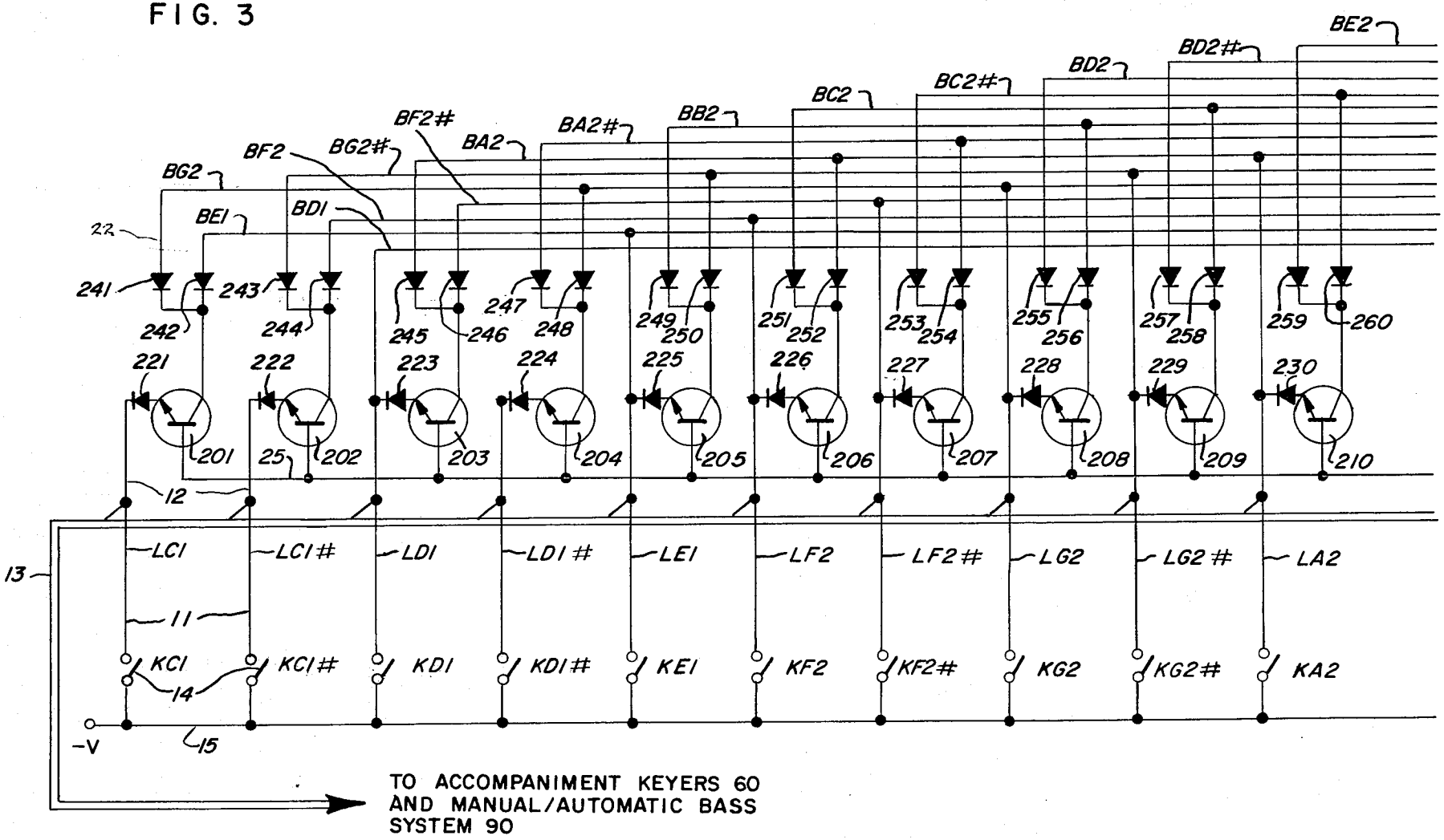
FIGS. 3 and 4 are assembled to make a complete circuit diagram of this invention.
Figure 4:
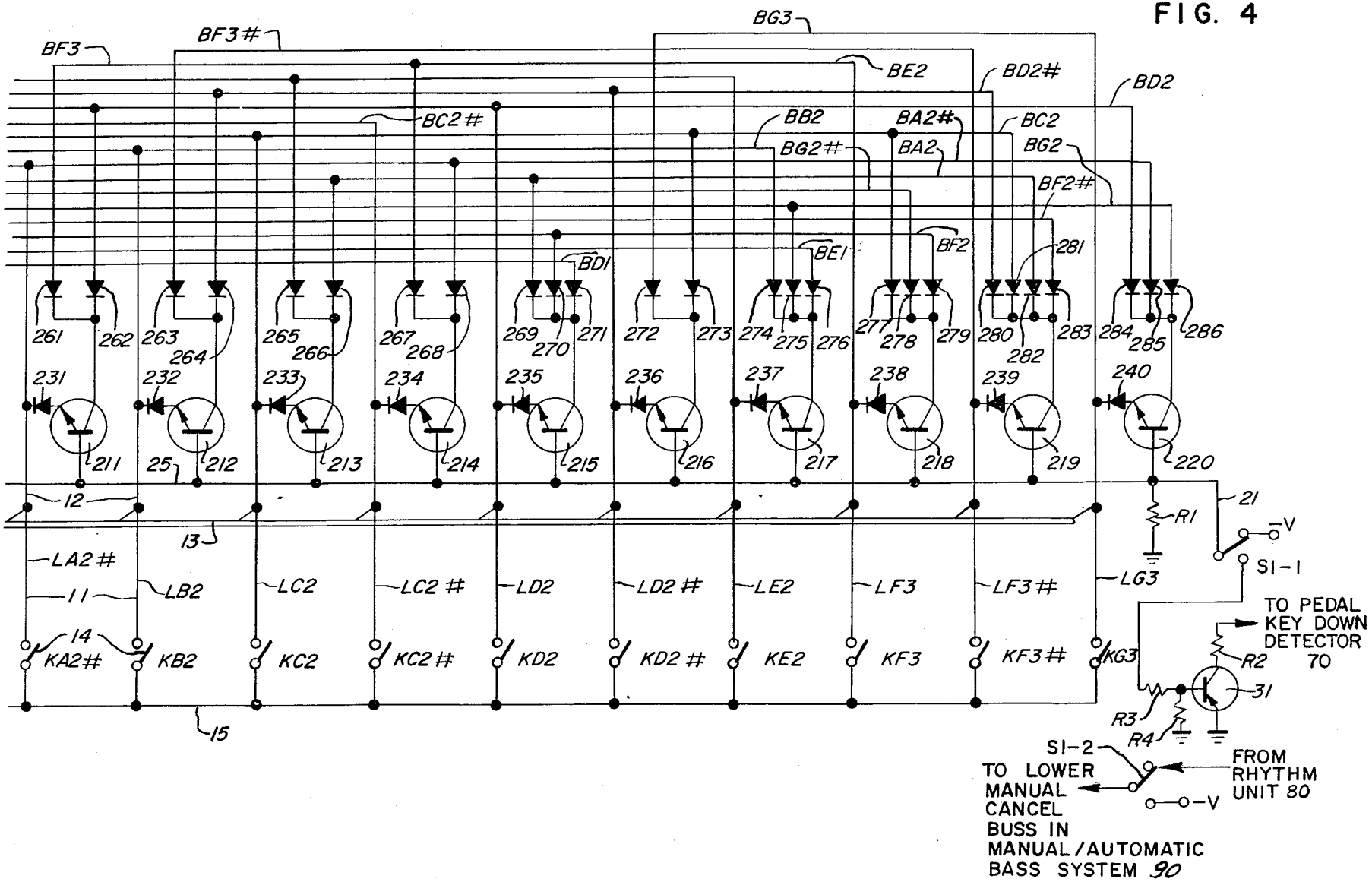

FIGS. 3 and 4 together constitute a circuit diagram of a one key chording system in accordance with this invention.

Figures 1, 2:
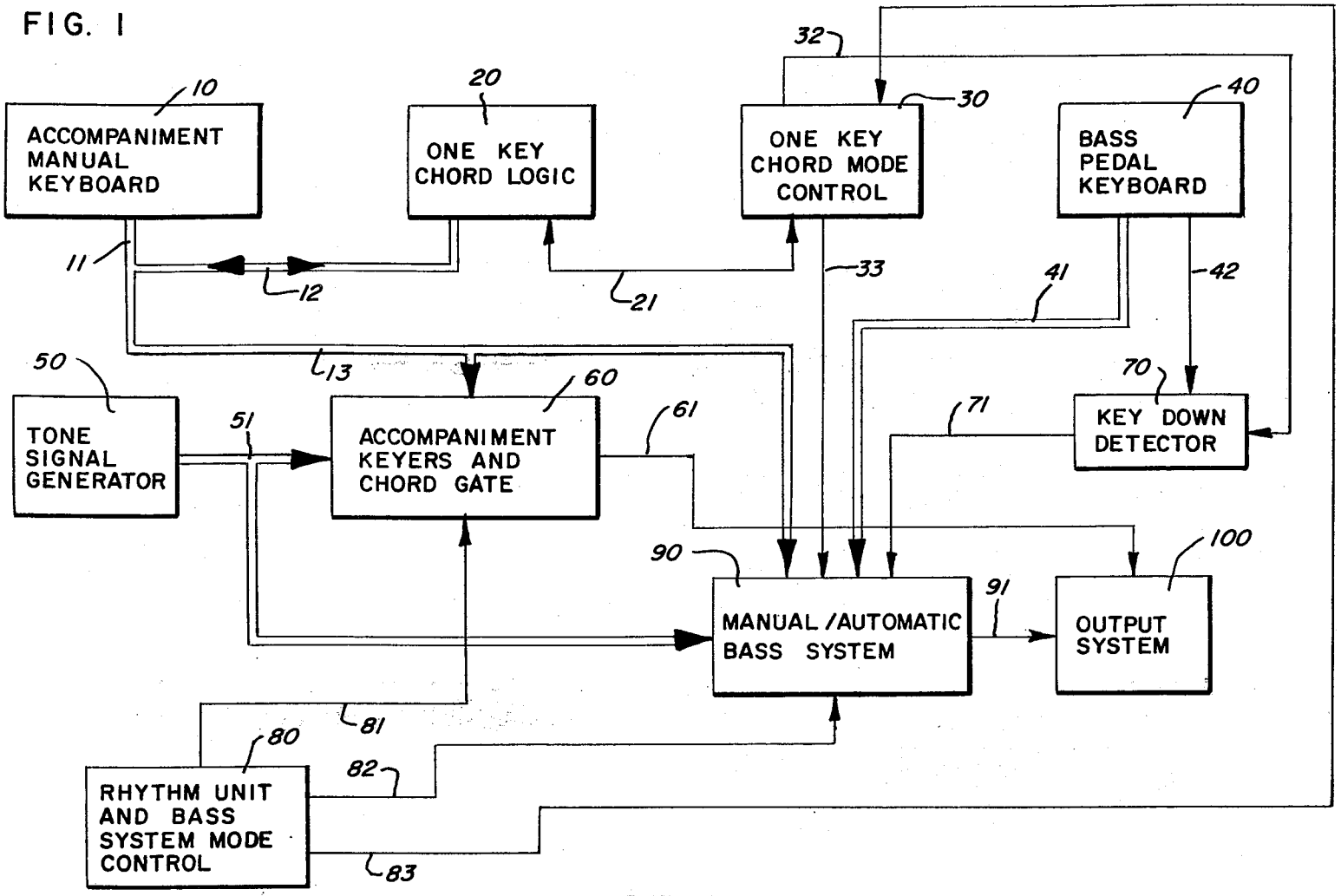

Referring to the block diagram in FIG. 1, an accompaniment manual keyboard 10 provides primary keying signals on keying signal leads in cable portion 11. These primary keying signals are carried by cable portion 13 to accompaniment keyers and chord gate 60 and to a manual/automatic bass system 90. Primary keying signals are also carried by cable portion 12 to one key chord logic 20 which responds to each primary keying signal by providing secondary keying signals on cable portion 12. Thus, cable portion 12 is, in effect, a two way cable. Each primary keying signal and its associated secondary keying signals together produce the sounding of a particular musical chord by causing accompaniment keyers in block 60 to key appropriate tone signals on cable 51 from tone signal generator 50 to output system 100 via signal line 61.

Tone signal generator 50 also supplies tone signals via cable 51 to manual/automatic bass system 90 which gates bass frequency tone signals to output system 100 via signal line 91. The bass frequencies gated are determined by the primary and secondary keying signals carried by cable portion 13 or by bass pedal keying signals produced on cable 41 by bass pedal keyboard 40, depending upon the mode of operation of the system.

One key chord mode control 30 controls the operation of one key chord logic 20 to place the system in one of two possible chording modes: (1) normal chording with multiple key actuation as in normal organ playing and (2) one key chording with one key actuation producing a complete chord. Rhythm unit and bass system mode control 80 places manual/automatic bass system 90 in one of two different operating modes with operating characteristics partly dependent on the chording mode employed to achieve a desired musical performance. For purposes of illustrating and describing a preferred embodiment of this invention, it will be assumed that the organ system depicted in FIG. 1 is one of the Autochord family of organs sold by Hammond Organ Company such as the Dolphin model 9200. In this organ system the manual/automatic bass system comprises a high-low preference network which receives keying signal information from both the accompaniment manual 10 and bass pedal keyboard 40. This overall system shown in FIG. 1 has four selectable modes of operation:

A. Normal chording/manual bass. In this mode, one key chord logic 20 is turned off by one key chord mode control 30 via a signal on line 21. Thus, only primary keying signals from accompaniment keyboard 10 are directed to accompaniment keyers and chord gate 60 and to bass system 90. A signal on line 83 from bass system mode control is coupled through one key chord mode control 30 to signal line 33 to command bass system 90 to process only keying signals from pedal keyboard 40. A signal on line 82 from bass mode control 80 sets bass system 90 to gate only the low note from the high-low preference network and sets the bass tone gate to continuous operation. A signal from mode control 80 on line 81 keeps the chord gate in block 60 on so that normal chording operation is produced. Keydown detector 70 receives information from pedal keyboard 40 on line 42 to detect when a pedal key is actuated and sends a signal on line 71 to a bass tone gate in bass system 90 to cause the low pedal tone signal to be gated on to line 91. Thus in this mode, the player performs in the traditional manner with multiple key chording on accompaniment manual 10 and monophonic, low select bass note playing on pedal keyboard 40. The rhythm unit in block 80 may be operating but is not controlling any of the gating of chord and bass tone signals.

B. One finger chording/manual bass. In this mode, one key chord logic 20 is turned on by one key chord mode control 30 via line 21. Thus, both primary and secondary keying signals from accompaniment keyboard 10 and one key chording logic 20 are directed via cable 13 to accompaniment keyers 60 and bass system 90. All of the other control signals are the same as in mode A, except that one key chord mode control 30 sends a signal via line 33 to bass system 90 to cause the high-low preference network to process keying signals on cable 13. Keying signals from pedal keyboard 40 are also processed in this mode, but actuation of pedal keys is not intended in this one key mode and thus does not cause a problem for the system. Since the automatic bass system is in the manual mode, a signal is provided by one key chord logic 20 on line 21 whenever any accompaniment key is actuated. This signal causes one key chord mode control 30 to send a signal on line 32 to key down detector 70 which sends a signal on line 71 to operate a bass tone gate in bass system 90 to gate the low select bass note on line 91 to output system 100. The end result is that one key actuation on the accompaniment manual produces continuous sounding of the chord designated for that key and also continuous sounding of the low bass note of the chord. As will be seen later, one key chord logic 20 is preferably constructed such that the low note of the chord which is sounded in the bass is the root of the chord since this is musically preferable.

C. Normal chording/automatic bass. In this mode. the player actuates multiple keys corresponding to chords on accompaniment manual 10. One key chord logic 20 is off and a signal on line 83 from bass mode control 80 is coupled through chord mode control 30 to bass system 90 to cause the preference system therein to be controlled by keying signals from accompaniment keyboard 10. Rhythm unit 80 operates a chord gate in block 60 and a bass gate in block 90 to produce gating of chord and bass tone signals in a well known manner to produce accompaniment and bass rhythm automatically.

D. One finger chording/automatic bass. This mode is similar to mode (C) except that the player actuates only one key to produce chord keying and chord mode control 30 itself supplies a signal on line 33 to cause the preference system in bass system 90 to be controlled by keying signals from both accompaniment keyboard 10 and one key chord logic 20.

It should be apparent that other types of automatic bass system could readily be adapted to incorporate the one key chording system of this invention.

FIGS. 3 and 4 assembled as shown in FIG. 2, illustrate schematically accompaniment manual 10, one key chord logic 20 and chord mode control 30. Keyswitches 14 are player actuatable to produce primary D.C. keying signals on leads 11 by connecting leads 11 to a keying buss 15 which is supplied with a direct current voltage −V. Each of keyswitches 14 is designated by an associated note of the musical scale. For example, KC1 designates the keyswitch associated with note C in the first octave of the accompaniment keyboard. Leads 11 are similarly designated by associated notes of the musical scale, as are busses 22.

Transistors 201–220 comprise a set of chord gates and diodes 241–286 comprise a set of chord logic units. A double pole switch S1-1, S1-2 together with transistor 31 and related components R2, R3, R4 comprise one key chord mode control 30. A lead 25 interconnecting the bases of transistors 201–220 comprises an inhibit means which will be explained more fully below.

In the normal keying mode, switch poles S1-1 and S1-2 are in the position shown in FIG. 4. Lead 21 is connected through switch pole S1-1 to D.C. potential −V and transistors 201–220 remain off regardless of actuation of any of keyswitches 14 because all of their base-emitter junctions are biased to a cut-off condition. Switch pole S1-2 connects rhythm unit and bass mode control 80 to bass system 90 such that the signal from rhythm unit 80 controls whether bass system 90 responds to keying signals from accompaniment keyboard 10 or from bass keyboard 40. In this mode, only primary keying signals produced by actuation of keyswitches 14 will be supplied to cable 13 to actuate accompaniment keyers. Diodes 221–240 connected between the emitters on transistors 201–220 and respective keying leads 12 prevent the reversed-biased base emitter junctions of the transistors from acting as zener diodes and placing a reduced negative voltage on leads 12 which would partially turn on all of the accompaniment keyers.

In the one key chord keying mode, switch poles S1-1 and S1-2 are placed in the alternate positions from those shown in FIG. 4. Switch pole S1-2 connects a D.C. potential −V to the lead to the lower manual cancel buss in bass system 90 to cause bass system 90 to accept keying signal inputs from accompaniment keyboard 10. Switch pole S1-1 disconnects mode control line 21 from −V and connects it to the base of transistor 31 through resistor R3. Because of the removal of the −V potential from line 21, each of transistors 201–220 will be turned on if a primary keying signal from an actuated keyswitch 14 is applied to its emitter through its associated one of diodes 221–240.

A typical example will be sufficient to illustrate the operation of this circuitry in the one key chording mode. Assume keyswitch 14 designated KC1 is actuated and that −V on buss 15 is equal to −20 volts. The −20 volt potential is applied via lead LC1 to the cathode of diode 221. Diode 221 and transistor 201 are turned on because the −20 volts signal forward biases diode 221 and the base-emitter junction of transistor 201. When transistor 201 turns on, the combined voltage drops across its base-emitter junction and diode 221 produce a voltage on inhibit line 25 of approximately −18.8 volts. The voltage on the collector of transistor 201 becomes approximately −19.1 volts due to the combined voltage drops of diode 221 and the collector-emitter circuit of the transistor. This −19.1 voltage turns on diodes 241 and 242 to place a signal of about −18.5 volts on busses 22 which are designated BE1 and BG2. Buss BE1 conducts the −18.5 volt signal to lead LE1 and the cathode of diode 225. This results in a secondary keying signal on lead LE1 which is carried by cable 13 to operate an E note keyer in accompaniment keyer block 60 (FIG. 1). Similarly, buss BG2 conducts the −18.5 volts signal to lead LG2 and the cathode of diode 228. This results in a secondary keying signal on lead LG2 which is carried by cable 13 to operate a G note keyer in accompaniment keyer block 60. The primary keying signal on lead LC1 is also carried via cable 13 to operate a C note keyer. With C, E, and G note keyers operated, a C major chord is sounded.

The secondary keying signals of −18.5 volts level on leads LE1 and LG2 do not turn on transistors 205 and 208 due to the presence of inhibiting voltage of −18.8 volts on inhibit line 25 which keeps the base-emitter junction of transistors 205 and 208 reverse biased. Consequently, as long as only one keyswitch 14 is actuated, only one of transistors 201–220 is turned on at any time and only the chord associated with the actuated keyswitch is keyed.

Diodes 241–286 provide unidirectional signal flow from the collectors of transistors 201–220 to busses 22 which carry secondary keying signals. This is required to limit the conducting of secondary keying signals to only the appropriate keying leads. In the example above, the −18.5 volts signal on buss BE1 is carried to the anode of diode 276 which couples the collector of transistor 217 to buss BE1. If diodes 276 and its companion diodes 274 and 275 were not present, the −18.5 volts secondary keying signal would also be coupled to busses BG2 and BB2 and via those busses and other connections to other busses and associated keying signal leads. The results would be operation of all of the keyers and sounding of all of the notes. These diodes also prevent unwanted coupling of primary keying signals on respective leads 11 to other keying leads via busses 22.

The following chart shows the chords assigned to each of keyswitches 14, the components involved in associated chord gates and chord logic units, and the notes sounded to provide the associated chord (with designation of sharps rather than flats):

| KEY SWITCH | CHORD | CHORD GATES (TRANSISTOR ASSOC. DIODE) | CHORD LOGIC UNITS (DIDOES) | CHORD NOTES |
|---|---|---|---|---|
| KC1 | C maj. | 201, 221 | 241, 242 | C1 E1 G2 |
| KC1 No. | D$^b$ maj. | 202, 222 | 243, 244 | C1 No. F2 G2 No. |
| KD1 | D maj. | 203, 223 | 245, 246 | D1 F2 No. A2 |
| KD1 No. | E$^b$ maj. | 204, 224 | 247, 248 | D1 No. G2 A2 No. |
| KE1 | E maj. | 205, 225 | 249, 250 | E1 G2 No. B2 |
| KF2 | F maj. | 206, 226 | 251, 252 | F2 A2 C2 |
| KF2 No. | F No. maj. | 207, 227 | 253, 254 | F2 No. A2 No. C2 No. |
| KG2 | G maj. | 208, 228 | 255, 256 | G2 B2 D2 |
| KG2 No. | A$^b$ maj. | 209, 229 | 257, 258 | G2 No. C2 D2 No. |
| KA2 | A maj. | 210, 230 | 259, 260 | A2 C2 No. E2 |
| KA2 No. | B$^b$ maj. | 211, 231 | 261, 262 | A2 No. D2 F3 |
| KB2 | B maj. | 212, 232 | 263, 264 | B2 D2 No. F3 No. |
| KC2 | A min. | 213, 233 | 265, 266 | C2 A2 E2 |
| KC2 No. | B$^b$ min. | 214, 234 | 267, 268 | C2 No. A2 No. F3 |
| KD2 | D min. | 215, 235 | 269–271 | D1 D2 F2 A2 |
| KD2 No. | C min. | 216, 236 | 272, 273 | D2 No. C2 G3 |
| KE2 | E min. | 217, 237 | 274–276 | E2 E1 G2 B2 |
| KF3 | F min. | 218, 238 | 277–279 | F3 C2 F2 G2 No. |
| KF3 No. | F No. dim. | 219, 239 | 280–283 | F3 No. F2 No. A2 C2 D2 No. |
| KG3 | G min. | 220, 240 | 284–286 | G3 G2 A2 No. D2 |

As mentioned above in the description of FIG. 1, it is necessary to provide a keydown signal when the instrument is in the one key chord/manual bass mode. To accomplish this, whenever one of keyswitches 14 is actuated to turn on one of transistors 201–220, the inhibit voltage on line 25 is also employed to turn on transistor 31 which applies a resistive load to pedal keydown detector 70.

It will be noted in the chart above that, in each instance, the note associated with the keyswitch designation appears in the chord notes. This results from the circumstance that the primary keying signal is used in each instance to key a note tone signal which is one component of the chord. However, in the last four lines of the chart, the note associated with the keyswitch one octave below is also employed. The reason for this is related to the particular characteristics of the automatic bass system which formed the basis for the description of FIG. 1 and to the desirability of having the low select bass note sounded in the one finger chord/manual bass mode be the root note of the chord. The details of this are not relevant to this invention of a one key chording system and need not be explained in detail here. To complete the overall disclosure of a preferred embodiment of this invention and its operating environment, the Service Manual for the Dolphin 9000 Series Organ is hereby incorporated herein by reference. This service manual is available to the general public for a nominal fee from Hammond Organ Company, 11610 Copenhagen Court, Franklin Park, Illinois 60131.

It should be apparent, however, that the one finger chording system of this invention can be employed in any organ system which incorporates D.C. keying, with or without an automatic bass system. It can be employed in organ systems which have only some of the modes of operation described above in conjunction with FIG. 1. The system of this invention could employ more or fewer chords as desired. Thus, it should be understood that numerous changes could be made in the preferred embodiment described above without departing from the scope of this invention as claimed in the following claims.

I claim:

1. In an electronic keyboard instrument which includes:

a tone signal generating system for generating tone signals corresponding to notes in the musical scale;

an output system for translating tone signals into audible musical tones;

a set of tone signal keyers, each receiving one of said tone signals and being responsive to a keying signal on an input keying signal lead to key said tone signal to said output system; and a keyboard having a plurality of control elements, each of said control elements being identified in standard musical keyboard terms with a particular note of the musical scale and being selectively operable to apply a primary keying signal on an input keying signal lead of an associated keyer;

a one key chording system comprising:

a set of chord gates, each coupled to one of said keying signal leads and operative in response to a primary keying signal thereon to produce an output chord keying signal;

a set of chord logic units, each coupled to one of said chord gates and operative in response to a chord keying signal to supply a plurality of secondary keying signals to keying signal leads of a preselected group of keyers such that said primary and secondary keying signals will operate a group of keyers associated with notes comprising a musical chord; and inhibit means coupled to said chord gates for inhibiting operation of said chord gates in response to secondary keying signals.

2. Apparatus as claimed in claim 1, wherein said one key chording system further comprises mode control means coupled to said chord gates and operable selectively by a player of said instrument to inhibit operation of all of said chord gates and thereby to return said instrument to a normal mode of operation without one key chording.

* * * * *